United States Patent [19]

Shay, Jr.

[11] 4,254,840

[45] Mar. 10, 1981

[54] DRILL BIT INSERT

[75] Inventor: William Shay, Jr., Conroe, Tex.

[73] Assignee: Reed Tool Company, Houston, Tex.

[21] Appl. No.: 949,283

[22] Filed: Oct. 5, 1978

[51] Int. Cl.[3] ..... E21C 13/00

[52] U.S. Cl. ..... 175/410

[58] Field of Search ..... 175/374, 409, 410

[56] References Cited

U.S. PATENT DOCUMENTS

| | | | |
|---|---|---|---|
| 3,442,342 | 5/1969 | McElya et al. | 175/410 X |
| 3,542,142 | 11/1970 | Hasiba | 175/410 X |
| 3,599,737 | 8/1971 | Fisher | 175/410 |
| 4,047,583 | 9/1977 | Dyer | 175/410 |
| 4,058,177 | 11/1977 | Langford, Jr. et al. | 175/410 X |
| 4,086,973 | 4/1978 | Keller et al. | 175/410 |

*Primary Examiner*—James A. Leppink

*Attorney, Agent, or Firm*—Michael J. Caddell

[57] ABSTRACT

A protruding insert for use in an oil well drill bit is disclosed which insert is made of a hard metal substance and utilizes a tangential spherical surface having opposed flattened sides.

6 Claims, 3 Drawing Figures

DRILL BIT INSERT

BACKGROUND OF THE INVENTION

There are many varied forms and shapes of inserts being utilized in drill bits currently. One of the most common insert shapes utilizes a cylindrical base portion for insertion into the drilled opening or socket in the bit cutter, with the upper or protruding portion of the insert being substantially conical in shape. Many various shapes for the conical end of this insert are in use. Primarily, the truncated cone shape has the sharp edges rounded off and a relatively blunt tip remaining. Other variations utilize the truncated tip sharpened with opposed flats formed by cutting away a slice of the truncated cone on each side.

A second basic insert configuration as opposed to the cylindrical-frusto conical insert, is the cylindrical-hemispherical insert shape. This insert has a base portion which is cylindrical in nature and adapted to project into the cylindrical opening or socket in the cutter cone. The protruding portion of the insert is hemispherical-shaped. This insert is used substantially in drill bits for drilling hard formations.

The majority of drill bit inserts utilized in soft and medium formation bits comprise the cylindrical-frusto conical configuration with several variations of modification to the basic frusto conical protruding tip. Generally, these modifications previously consisted of "slabbing off" the opposing sides of the upper tip of the frusto conical section and a rounding off of the corners and sharper edges of the protruding end. The commonly termed chisel-shaped insert and the tooth-shaped insert essentially comprise a basic frusto conical shape with differing amounts of opposing sides "slabbed off". The result of such slabbing off is that the outer extending portion of the frusto-conical insert has a relatively long flat shape with a flat blunt outer end. This shape suffers from the disadvantage that the two outermost corners of the frusto-conical shape are subject to high stresses and therefore suffer rapid wear and/or early breakage. During the complex motion of the rolling cutters at the bottom of the well bore in the drilling operation, various portions of the insert are in contact with the formation being drilled at various points of rotation of the cutter on its lug. In many situations the first point of contact between the insert and the hard formation material occurs at one of the two flat projecting corners of the frusto conical shape. This oftentimes results in breakage of one of these corners or loosening of the insert in its cutter socket.

Another type of insert is a long, pointed, conical insert with hemispherical end and no flats. It is either too sharp and breaks easily or is too blunt and won't get good penetration in hard and medium-hard formations.

The present invention overcomes the difficulties of the frusto conical insert shape by utilizing a combination of cylindrical, conical, hemispherical and flat surface configurations in the insert design.

DESCRIPTION OF THE PREFERRED EMBODIMENTS

Figure 2:
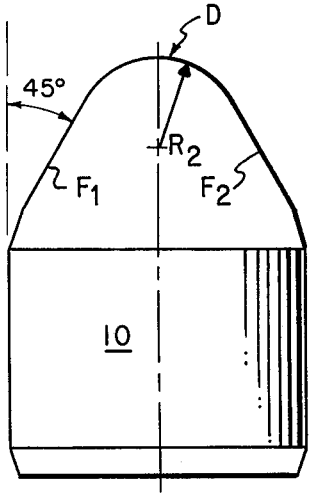
FIG. 2 is a side elevational view taken at 90° to FIG. 1.

Referring to the drawings, a drill bit insert 10 is disclosed, having a substantially cylindrical base portion A with a lower beveled shoulder D formed thereon for insertion into a drilled insert socket in a drill bit cutter. From the cylindrical portion A there extends upward a conical section B having sides formed at a 30° angle with the vertical as indicated by the dimension arrows. A hemispherical end portion C is formed tangentially to the conical sides B to, in effect, remove the apex or pointed end of the cone from section B. The hemispherical end C has a radius of curvature $R_1$ from a point P. Referring to FIG. 2, a secondary cylindrical shape D is formed on the upper end of insert 10 at a radius $R_2$ which is substantially smaller than radius $R_1$. The surface D is formed at right angles to surface C by the rotation of radius $R_2$ in a plane normal to the plane containing $R_1$. A pair of opposed flattened sides $F_1$ and $F_2$ are formed by running two planes tangentially to the outer surfaces of surface D down to intersect the conical surface B at some desirable predetermined distance above the top of cylindrical section A. The "sharpness" resulting from the smaller radius of surface D and opposed planes $F_1$ and $F_2$ is controllable and a direct result of the selection of $R_2$ and the intersection points with conical surface B.

Figure 3:
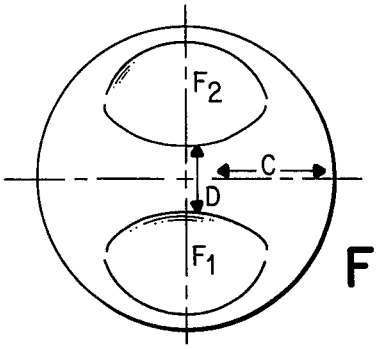
FIG. 3 is a top view of the insert of FIGS. 1 and 2.

FIG. 3 illustrates in plan view, the sharpened, hemispherical frusto-conical protrusion of insert 10.

Figure 1:
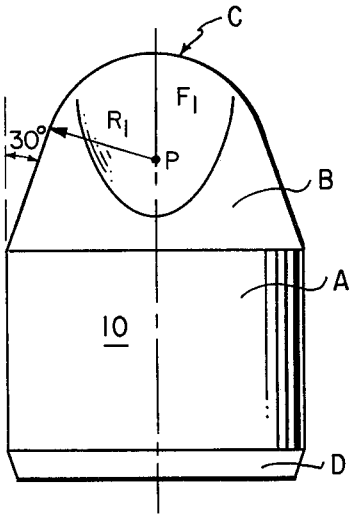
FIG. 1 is a front elevational view of an insert according to the present invention.

Thus, it is clear from examining the unique insert structure defined in this invention and more particularly from examining FIG. 1, that as the cutter of the drill bit containing inserts made according to this invention rotates at the bottom of the hole and brings each successive insert into contact with bottom hole, that there are no sharp protruding corners on this sharpened insert to undergo undue stresses and cause failure or breakage. Consequently, the insert is superior in its resistance to early failure, breakage and loosening of the insert in the cutter socket. On the other hand, the insert is advantageous in many formations in that the "sharpened" aspect of the insert provides a much faster rate of penetration than would a normal hemispherical shaped insert. Thus, the present invention provides a sharpened insert having unusual strength and wear characteristics which allow a much faster rate of penetration in many softer and medium formations without sacrificing any of the strength and wear ability of the superior hemispherical-ended inserts.

Although certain preferred embodiments of the present invention have been herein described in order to provide an understanding of the general principles of the invention, it will be appreciated that various changes and innovations can be affected in the described drill bit insert without departing from these principles. All modifications and changes of this type are deemed to be embraced by the spirit and scope of the invention except as the same may be necessarily limited by the appended claims or reasonable equivalents thereof.

I claim:

1. An insert for a drilling bit, said insert comprising:

a body having a generally cylindrical base section adapted for snug-fitting engagement in a rolling cutter; and, a protruding end on said body, said end having a substantially frusto-conical lower portion adjacent said cylindrical base section, a tangential, substantially hemispherical end portion formed on said frusto-conical portion, and flats formed on opposing sides of said hemispherical end portion in generally converging orientation.

2. The drilling bit insert of claim 1 wherein said hemispherical end portion has a radius of curvature substantially equal to the radius of said frusto-conical portion at the point of intersection of said two portions, and the slope of said frusto-conical portion is about thirty degrees inward from a vertical line extending upward from said cylindrical base section.

3. The drilling bit insert of claim 3 wherein said flats are formed at an angle of about 45 degrees inward from a vertical line extending upward from said cylindrical base section.

4. The drilling bit insert of claims 2 or 3 wherein said end portion between said flats is formed at a radius sufficiently small enough to intersect said flats on a tangent.

5. An insert for a drilling bit, said insert comprising:

a body having a generally cylindrical base section adapted for snug-fitting engagement in a rolling cutter; and, a protruding portion on said body; said protruding portion having a substantially frusto-conical lower section adjacent said cylindrical base section, a compound hemispherical end portion tangential to said lower section, and opposed flats on said end portion in generally converging orientation and tangential to said compound hemispherical end portion.

6. A drill bit insert consisting essentially of a cylindrical base section, a frusto-conical intermediate section joining said base section, a curved end section joining said intermediate section, and opposed flats on said end section; said curved end section have a compound circular configuration tangential to said intermediate section and said opposed flats.

* * * * *